United States Patent [19]

Wittmoser

[11] Patent Number: 4,877,078

[45] Date of Patent: Oct. 31, 1989

[54] PATTERN FOR USE IN LOST PATTERN FOUNDRY PROCESS

[76] Inventor: Adalbert Wittmoser, 6840 Lampertheim, Fed. Rep. of Germany

[21] Appl. No.: 303,282

[22] Filed: Jan. 26, 1989

[30] Foreign Application Priority Data

Jan. 30, 1988 [DE] Fed. Rep. of Germany ..... 3802727
Jul. 4, 1988 [DE] Fed. Rep. of Germany ..... 3822601

[51] Int. Cl.[4] ..... B22C 9/04

[52] U.S. Cl. ..... 164/34; 164/45; 164/246

[58] Field of Search ..... 164/34, 35, 36, 45, 164/246

[56] References Cited

U.S. PATENT DOCUMENTS

| | | | |
|---|---|---|---|
| 4,239,725 | 12/1980 | Crivello | 264/328.6 |
| 4,633,929 | 1/1987 | Santangelo et al. | 164/246 |
| 4,763,715 | 8/1988 | Cannarsa et al. | 164/45 |
| 4,773,466 | 9/1988 | Cannarsa et al. | 164/45 |

*Primary Examiner*—Richard K. Seidel
*Attorney, Agent, or Firm*—Cook & Egan

[57] ABSTRACT

The present invention contemplates a new plastic foam material which may be used to fabricate patterns for use in the Full Mold or Lost Pattern Foundry Process. Moreover, the present invention contemplates the application of organo metallic compounds to the situs of the plastic foam patterns used in the Lost Pattern Process, whereby the plastic foam patterns are vaporized during the casting process without the formation of solid carbon decomposition products. This means the casting is made in the presence of an organo metallic compound which effectively hinders the formation of solid carbon during the vaporization of the plastic foam pattern. It was found that the addition of an organo metallic compound such as metalocene to the plastic foam is surprisingly effective in this respect. The metalocenes, especially ferrocene, aluminocene and manganocene, are very effective in creating a substantially complete vaporization or gasification of the plastic foam pattern material in a short time, without the formation of solid carbon. Furthermore, derivatives of metalocenes have a similar effect, so the selection of the preferred organo metallic compound is more or less a question of economics.

10 Claims, No Drawings

PATTERN FOR USE IN LOST PATTERN FOUNDRY PROCESS

BACKGROUND OF THE INVENTION

1. Field of the Invention

The present invention relates to improvements to the lost pattern foundry process and, specifically, to improved plastic foam patterns for use in the lost pattern foundry method.

2. Discussion of the Background

Metal castings may be made from ferrous or nonferrous metal alloys using the lost pattern foundry process which is sometimes referred to as the Full Mold Casting Process. Molds for the Full Mold Casting Process are made by forming a foundry aggregate around a plastic foam pattern which will vaporize when contacted by the hot metal. The aggregate may be held in the desired mold shape by binders. During the casting operation molten metal is poured into the mold where it causes the plastic foam pattern to vaporize. The molten metal fills the mold cavity from which the pattern has been vaporized and the metal solidifies in the mold to yield the desired casting.

It has been found, particularly in industrial foundries, that it is more difficult to obtain uniform quality casting with the Full Mold Casting Process, as compared to processes using ordinary hollow molds. Castings made using the Full Mold Casting Process very often show characteristic surface defects, usually called "residues" when the Full Mold Casting Process is incorrectly carried out. It has been found that such surface defects are caused by incomplete vaporization or gasification of the plastic foam pattern material during the casting process. This plastic foam pattern is usually produced from a foam produced from a carbon containing plastic material, such as polystyrene, polymethacrylate (PMMA) and the like. The use of these types of plastic foam pattern material has the disadvantage in that the casting process causes the thermal decomposition of the plastic, wherein substantial amounts of solid carbon residues (soot up to crystallized) are produced. For example, a polystyrene plastic foam pattern may decompose to leave as much as 50 percent of the total weight as a solid carbon residue. This solid carbon residue causes defects in castings produced by the Full Mold Casting Process, which defects can render the casting's commercial unacceptability. Therefore, it was necessary to use special technological means to keep these solid carbon residues as low as possible. Prior art authors added halogens to the plastic foam used for patterns to try to stop the decomposition of the plastic foam into solid carbon, i.e. by adding a so-called free radical producing agent. Furthermore, there has been an attempt to substitute for the conventional polystyrene foam pattern material other plastic foams having a minor content of carbon. It was found that plastic foams other than polystyrene have other disadvantages without sufficiently solving the solid carbon formation problem during the Full Mold Casting Process.

SUMMARY OF THE INVENTION

Accordingly, it is an object of this invention to provide an improved Full Mold Casting Process and a new plastic foam pattern material for the preparation of molds for use in the Full Mold Casting Process, and for providing castings pieces which have a uniform quality and are substantially or completely free of the foregoing disadvantages.

The present invention contemplates a new plastic foam material which may be used to fabricate patterns for use in the Full Mold or Lost Pattern Foundry Process. Moreover, the present invention contemplates the application of organo metallic compounds to the situs of the plastic foam patterns used in the Lost Pattern Process, whereby the plastic foam patterns are vaporized during the casting process without the formation of solid carbon decomposition products. This means the casting is made in the presence of an organo metallic compound which effectively hinders the formation of solid carbon during the vaporization of the plastic foam pattern. It was found that the addition of an organo metallic compound such as metalocene to the plastic foam is surprisingly effective in this respect. The metalocenes, especially ferrocene, aluminocene and manganocene, are very effective in creating a substantially complete vaporization or gasification of the plastic foam pattern material in a short time, without the formation of solid carbon. Furthermore, derivatives of metalocenes have a similar effect, so the selection of the preferred organo metallic compound is more or less a question of economics.

During the tests performed by the inventor, the formation of solid carbon was decreased by 50–70% by weight during the vaporization or gasification of the lost pattern containing 0.1% by weight of ferrocene in casting a nodular iron melt in the Full Mold Casting Process. Such decrease of the formation of solid carbon was sufficient to avoid defects in the casting and allow a decrease of the presence of graphitic residues on the surface of the castings.

The improved vaporization of the plastic foam pattern (without solid carbon formation) in the Full Mold Casting Process could be demonstrated by experiments, for example, by adding an organic coloring material to the foam in very small amounts, helping to promote the absorption of the thermal radiation of the melt (according to German Pat. No. 1,234,937). Furthermore, the organo metallic compounds may be added to the coating which covers the plastic foam pattern in order to further improve the vaporization, without the formation of solid carbon. In some cases according to the inventor, it was sufficient to apply the organo metallic compound only to the coating enveloping the plastic foam pattern. Furthermore, the organo metallic compounds according to the invention may be added to the mold material (i.e., sand or the like), which surrounds the lost pattern. Still further, one may apply the organo metallic compound to the plastic foam pattern before or during the casting procedure by pressure or under vacuum, and thereby avoid the creation of graphite or other solid carbon during the vaporization of the plastic foam pattern. According to the circumstances, it is possible to use these different means to apply the organo metallic compound to the mold separately or in combination.

The plastic foam material which is used for production of lost patterns, according to the invention, can contain an effective amount, and preferably from 0.01 to 1% by weight of an organo metallic compound. Preferably, the plastic foam consists essentially of polystyrene and contains at least one metalocene. One may also use plastic foams other than polystyrene. For example, it is possible to use foamed styrene copolymers, polycarbonates, polyolefines, polyurethanes, polymers of isocyanurates, polycarbodimides, polymethacryalamides, polyamides, ABS-foams, phenolicurea formaldehyde foams and ureaformaldehyde resin foams.

The preferred organo metallic compounds are the metalocenes. Among the metalocenes it has been found that ferrocenes, aluminocenes and manganocenes are especially useful for the Full Mold production of castings by conventional casting alloys. One may also use substituted metalocenes and metalocene analogs. In some cases it is advantageous to choose a metalocene wherein the metal component of the metalocene is present in the metals contained in the melt used to produce the castings. This means that ferrocenes and manganocenes are especially useful to cast steel and cast iron. According to the invention, the organo metallic compound to be used preferably contains at least one metalocene, most preferably ferrocene and/or manganocene. Ferrocene and/or manganocene are preferred because they are stable and are easy to handle during the production, distribution and application, e.g. as a fluid solution without danger.

The following Examples will serve to illustrate the process of the present invention, but it is understood that these Examples are set forth merely for illustrative purposes.

EXAMPLE 1

(Comparison Example)

Foamed-to-shape patterns for casting automobile parts were used in the Full Mold Casting Process. The patterns were produced by foaming polystyrene to a density of 18 kp/m$^3$. A nodular cast iron melt was used at a casting temperature of 1390° C. The smallest wall thickness was 4 mm. The weight of the casting was approximately 25 kg. The molding material was binder-free quartz sand. In the first test series patterns were made with polystyrene containing no organo metallic compound. These patterns were used in the Full Mold Casting Process and test pieces were cast. The castings produced showed an unacceptable surface quality due to graphitic deposits, especially on the upper surface of the casting.

EXAMPLE 2

The same arrangement as in Example 1 was used for the second test series castings of the same automobile parts. However, in this case the patterns were made from polystyrene which included from 0.05 to 0.1% by weight of ferrocene. Contrary to the appearance of the castings of Example 1, these casting have shown an excellent surface, free of defects.

EXAMPLE 3

(Comparison Example)

Patterns for a gear case were used in a Full Mold Casting Process. The patterns were produced by polystyrene foam with a density of 18 kp/m$^3$. A grey cast iron melt at casting temperature of 1360° C. was used. The average wall thickness was 35 mm. The weight of the casting was approximately 450 kg. The molding material was a cold-set furan resin bound foundry sand. In the first test series, the patterns were made from polystyrene which contained no organo metallic compound, which patterns were used for Full Mold production and casting of test pieces. The resulting castings had an unacceptable surface quality due to graphitic defects, especially on the upper surface of the casting.

EXAMPLE 4

The same arrangement as in Example 3 was used for a second test series of castings of the same gear cases. However, in this case the patterns were made from polystyrene which included from about 0.05 to 1% by weight of ferrocene. Contrary to the appearance of the castings of Example 3, these castings showed an excellent surface, substantially free of defects.

EXAMPLE 5

Steel castings were produced using the Full Mold Casting Process using steel melts with carbon content of 0.15% by weight. Polystyrene foam with a density of 18 kp/m$^3$ was used as lost patterns. Castings made using patterns without any addition of the organo metallic compound according to the invention showed surface carbon deposits of as much as 0.8% by weight. By the use of polystyrene patterns containing 0.05 to 1% by weight ferrocene with a density of 18 kp/m$^3$, according to the invention, it was possible to produce steel castings showing no carbon deposits on the casting.

The scope of the invention herein shown and described are to be considered only as illustrative. It will be apparent to those skilled in the art that numerous modifications may be made therein without departure from the spirit of the invention and the scope of the appended claims.

I claim:

1. In a method of manufacturing of metallic castings by using a vaporizable pattern of plastic foam to form a full mold for the casting process, the improvement comprising the addition to said mold of an effective quantity of at least one organo metallic compound to reduce the formation of solid carbon during the vaporization of the plastic foam pattern.

2. The method as described in claim 1, wherein said organo metallic compound consists of at least one metalocene and/or its derivate.

3. The method as described in claim 2, wherein said metalocene is selected from the group consisting of ferrocene, manganocene and/or aluminocene is used.

4. The method as described in anyone of claims 1 through 3, wherein an organic coloring is added to said organo metallic compound.

5. The method as described in any one of claims 1 through 3, wherein said organo metallic compound is added to said plastic foam.

6. The method as described in claim 5, wherein the amount of the organo metallic compound is from about 0.01 to about 1.0% by weight of the plastic foam.

7. The method as described in any one of claims 1 through 3, wherein the organo metallic compound is added to the coating used to envelope the plastic foam pattern.

8. The method as described in any one of claims 1 through 3, wherein the organo metallic compound is added to the molding material in which the plastic foam pattern is embedded.

9. The method as described in any one of claims 1 through 3, wherein the organo metallic compound is added to the mold before or during the pouring of the molten metal by the application of vacuum or pressure to the mold.

10. The method as described in any one of claims 1 through 3, wherein the metallic component of the organo-metallic compounds corresponds to one of the metals contained in the melt poured into the mold for production of the casting.

* * * * *